US009382658B2

(12) United States Patent
Tarifi

(10) Patent No.: US 9,382,658 B2
(45) Date of Patent: Jul. 5, 2016

(54) LINT TRAP

(71) Applicant: Mohamed H. Tarifi, Hillsboro Beach, FL (US)

(72) Inventor: Mohamed H. Tarifi, Hillsboro Beach, FL (US)

( * ) Notice: Subject to any disclaimer, the term of this patent is extended or adjusted under 35 U.S.C. 154(b) by 0 days.

(21) Appl. No.: 13/719,221

(22) Filed: Dec. 18, 2012

(65) Prior Publication Data

US 2014/0165415 A1 Jun. 19, 2014

(51) Int. Cl.

*D06F 58/00* (2006.01)
*D06F 58/22* (2006.01)
*D06F 58/20* (2006.01)

(52) U.S. Cl.

CPC ..... *D06F 58/22* (2013.01); *D06F 58/20* (2013.01)

(58) Field of Classification Search

CPC ..... D06F 58/00; D06F 58/22; D06F 58/23; F26B 19/00; F26B 21/00; F26B 21/06
USPC ..... 34/82, 90, 595, 468, 524; 29/401.1; 454/339
See application file for complete search history.

(56) References Cited

U.S. PATENT DOCUMENTS

| | | | | |
|---|---|---|---|---|
| 4,530,170 | A * | 7/1985 | Green | 34/82 |
| 5,121,948 | A * | 6/1992 | Anderson et al. | 285/147.1 |
| 5,210,960 | A * | 5/1993 | LaRue | 34/82 |
| 5,628,122 | A * | 5/1997 | Spinardi | D06F 58/22 137/132 |
| 5,675,908 | A * | 10/1997 | Barnes | 34/235 |
| 5,970,623 | A * | 10/1999 | Tuggle | 34/134 |
| 6,098,312 | A * | 8/2000 | Tuggle | 34/607 |
| 6,378,227 | B1 * | 4/2002 | Bradford | 34/235 |
| 6,682,415 | B1 * | 1/2004 | Vagedes | 454/339 |
| 7,497,030 | B2 * | 3/2009 | Belgard | 34/82 |
| 2004/0124129 | A1 * | 7/2004 | Booth | 210/232 |
| 2008/0047159 | A1 * | 2/2008 | Mackay | 34/82 |
| 2009/0223077 | A1 * | 9/2009 | Grunert et al. | 34/82 |
| 2010/0018071 | A1 * | 1/2010 | McKinley | 34/82 |
| 2010/0199515 | A1 * | 8/2010 | Steffens | 34/468 |
| 2012/0005913 | A1 * | 1/2012 | McKinley | 34/82 |
| 2013/0125410 | A1 * | 5/2013 | Gregory et al. | 34/82 |
| 2013/0219735 | A1 * | 8/2013 | Beaumont | 34/82 |
| 2013/0255094 | A1 * | 10/2013 | Bommels et al. | 34/85 |
| 2014/0013616 | A1 * | 1/2014 | Lee et al. | 34/524 |

FOREIGN PATENT DOCUMENTS

| | | | |
|---|---|---|---|
| EP | 2559805 A1 | * | 2/2013 |
| GB | 932564 | * | 7/1963 |
| KR | 20090024582 | * | 3/2009 |

* cited by examiner

*Primary Examiner* — Stephen M Gravini
(74) *Attorney, Agent, or Firm* — Lyman Smith

(57) ABSTRACT

A dryer lint trap has one opening operable to receive exhaust from a dryer and another opening to discharge the relatively lint free air flow into a high-rise building exhaust stack. The lint trap can remove lint with a water bath onto which dryer exhaust flows therein. The lint trap is totally sealed and the relatively lint free exhaust air is discharged into building exhaust stack by a duct that may have an in-line exhaust fan and connects to the discharge side of a bathroom exhaust fan. The in-line exhaust fan along with the bathroom exhaust fan and the dryer may be interlocked to affect simultaneous start and stop. In addition, the in-line exhaust fan works synergistically with the bathroom fan and the on-roof exhaust fan to efficiently discharge exhaust air into the atmosphere. This arrangement assures that no exhaust air is released into the living space and precludes mold generation.

16 Claims, 2 Drawing Sheets

LINT TRAP

BACKGROUND OF THE INVENTION

The present invention relates to a lint trap and, more particularly, to a lint trap that does not allow saturated hot air exhausted from a dryer from releasing into a living space.

When drying clothes, lint develops and much of this lint is collected by a lint screen in the dryer itself. However, a significant amount of lint gets by this lint screen and enters the dryer exhaust duct. This lint can build up in various dryer exhausts, be it a simple household vent, or a high-rise stack into which many dryer exhausts can flow. Many high-rise buildings may regulate dryer exhaust and not allow it to penetrate the exterior wall and exhaust to the atmosphere. In addition, owners are not allowed to exhaust directly to the building exhaust stack to prevent released lint from jamming the building on roof exhaust fan.

Based from experience, building departments allow tenants to exhaust their dryers into a lint trap. Current lint traps, although they do trap lint from a dryer exhaust they allow hot saturated air to be released into the living space, ultimately causing or contributing to severe mold conditions that can have catastrophic health issues for tenants. Current commercially available lint traps are comprised of a plastic box with one 4-inch opening and two air vents. The opening connects to dryer exhaust with a 4-inch flexible hose. The container is half filled with water. The other opening is left open. When the dryer exhaust hits the water in the lint trap, lint is trapped in the box and saturated hot air is released into the living space creating fertile condition for promoting deadly mold.

FIG. 1 shows an example of a conventional lint trap 100 having a 4-inch flex hose 102 that can connect to a dryer (not shown). Water 104 can be placed in the lint trap 100 to trap lint. The incoming air from the dryer can escape the lint trap 100 through air vents 106 disposed on a top portion of the lint trap 100.

As can be seen, there is a need for an improved lint trap that can trap lint but prevent saturated hot exhaust air from entering living space and resulting in serious health issues.

SUMMARY OF THE INVENTION

In one aspect of the present invention, a lint trap comprises a lint trap body operable to contain water therein; an inlet to the lint trap body, the inlet configured to connect to an exhaust of a dryer; an outlet from the lint trap body, the outlet configured to allow air entering the lint trap body to exit therefrom, wherein the lint trap body is a sealed member preventing the exhaust from exiting into the living space.

In another aspect of the present invention, a method for reducing lint in a dryer exhaust comprises passing dryer exhaust into a lint trap body through an inlet thereof; expelling the dryer exhaust onto water disposed in the lint trap body; and delivering a relatively lint free dryer exhaust out through an outlet from the lint trap body to a building exhaust stack with the help of in line exhaust fan(optional) and connected to a bathroom exhaust fan.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a dryer lint trap having two openings, with one opening operable to receive exhaust from a dryer and another opening to discharge the relatively lint free air flow into, for example, a high-rise building exhaust stack by way of an exhaust duct fitted with an in duct vacuum fan (optional) and connecting to the discharge side of a bathroom exhaust fan. The in-duct exhaust fan is only necessary when the duct connecting the lint trap to the building exhaust stack is unduly long, over 20 feet. The lint trap can remove lint with a water bath onto which dryer exhaust flows therein.

Figure 1:
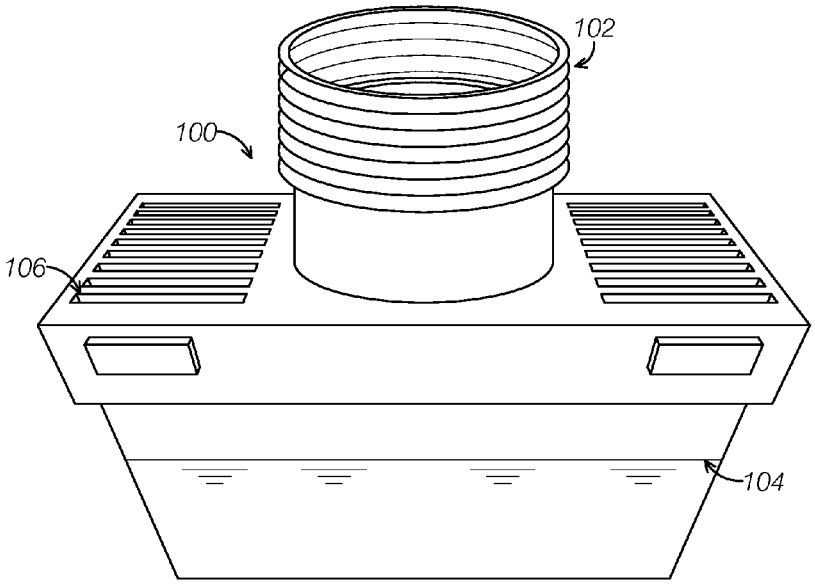
FIG.1 (PRIOR ART)
FIG. 1 is a cross-sectional view of a dryer lint trap according to the prior art.
Figure 2:
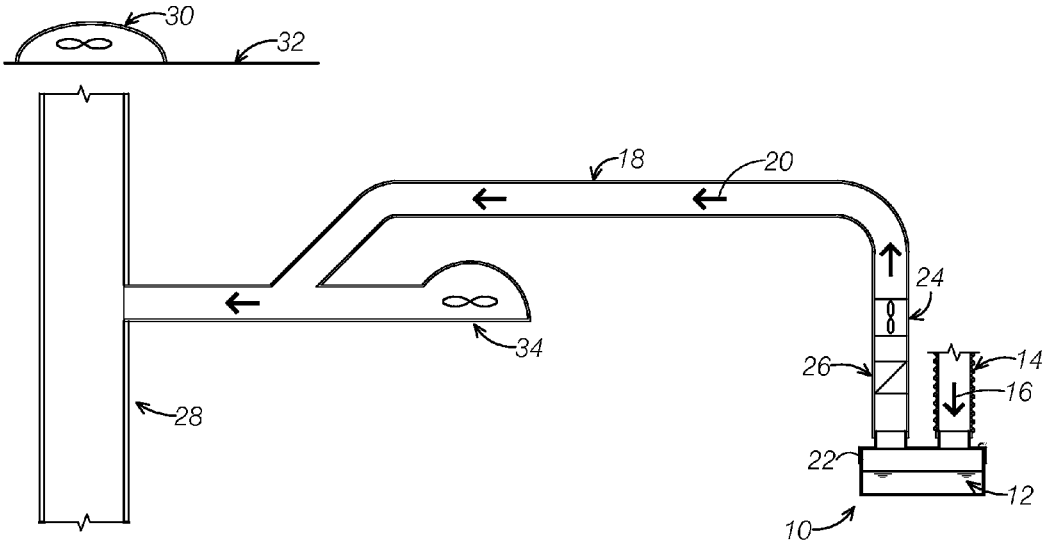
FIG. 2 is a cross-sectional view of a dryer lint trap according to an exemplary embodiment of the present invention.
Figure 3:
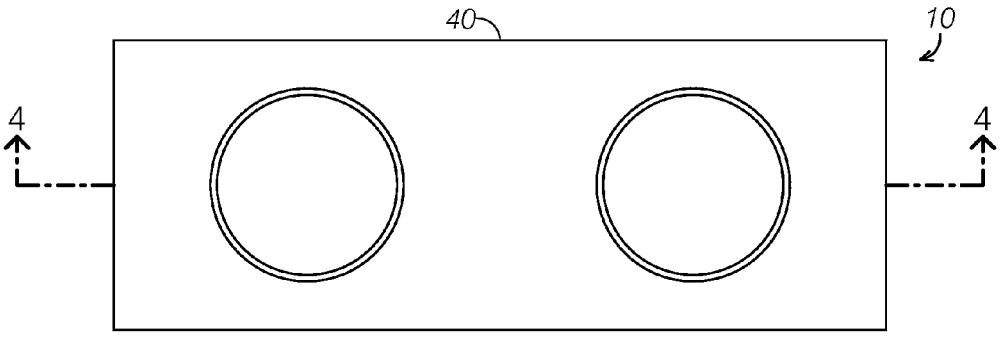
FIG. 3 is a top view of a dryer lint trap according to an exemplary embodiment of the present invention.
Figure 4:
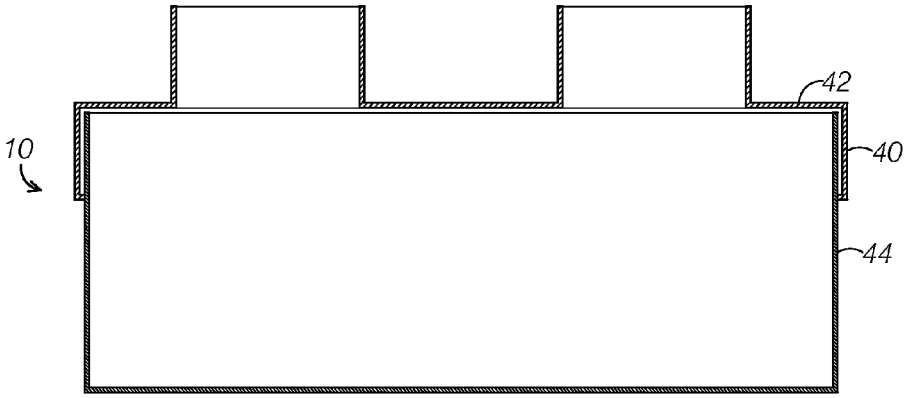
FIG. 4 is a cross-sectional view taken along line 4-4 of FIG. 3.
Figure 5:
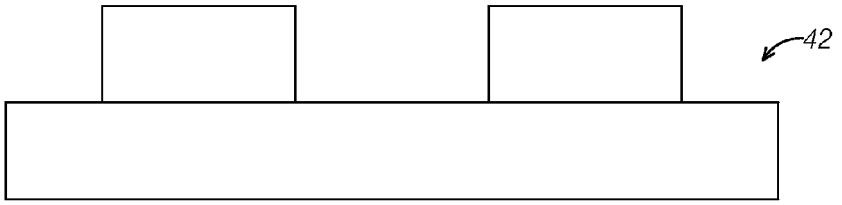
FIG. 5 is a side view of a dryer lint trap cover of the dryer lint trap shown in FIG. 3.

Referring now to FIGS. 2 through 5, a dryer lint trap 10 can have a lint trap body 22 to contain water 12 therein. Typically, the lint trap body 22 is a sealed container having an inlet 14 and an outlet 18. In some embodiments, the lint trap body 22 includes a cover 42, fitting over the lint trap body 22 to form the sealed unit. A gasket 40 can be disposed between the cover 42 and the lint trap body 22 to prevent air and/or lint to escape therefrom.

The lint trap body 22 may include a drain and/or a fill cap to add and/or remove water 12 from the lint trap body 22. In some embodiments, the lint trap body 22 can be removed from the inlet 14 and the outlet 18 to drain and add water 12 as well as to clean the lint trap body 22.

When the dryer is turned on, hot saturated air, along with lint from clothes (inlet air flow 16), is delivered through the inlet 14 into the lint trap body 22. The lint trap 10 captures the lint and saturated air 20 is evacuated through the outlet 18 to, for example, a building exhaust stack 28. Typically, the air evacuation is facilitated by an inline exhaust fan 24 (optional), a bathroom exhaust fan 34 and of course a roof vacuum fan 30 installed above the building exhaust stack 28 that extends through the building roof 32.

In some embodiments, the outlet 18 can include an exhaust fan 24 in-line therewith. The exhaust fan 24 helps facilitate dryer exhaust discharge from the outlet 18 in long exhaust ducts. The exhaust fan 24, and any bathroom or kitchen exhaust fan 34 are interlocked with the dryer (optional) to make sure that the fans 24, 34 are on when the dryer is on. In some embodiments, a back flow preventer 26 can be included to prevent back draft into the outlet 18 if the roof exhaust fan is down. The back flow preventer 26 can take various configurations, such as a check valve, or the like.

The lint trap 10 can be made of various materials, such as plastic, aluminum, stainless steel, galvanized steel, composites, or the like. The lint trap 10 can be hidden in a laundry center closet, for example, which can also hide the inlet 14 and outlet 18. This can allow a laundry station to fit into an apartment/condominium décor without undue clutter.

It should be understood, of course, that the foregoing relates to exemplary embodiments of the invention and that modifications may be made without departing from the spirit and scope of the invention as set forth in the following claims.

What is claimed is:

1. A lint trap system comprising:

a lint trap body operable to contain a pool of water therein;

an inlet to the lint trap body, the inlet configured to connect to an exhaust of a dryer, the inlet directing the exhaust from the dryer toward the pool of water;

a building exhaust stack extending through a building and venting to an environment through a vacuum fan thereof;

an outlet from the lint trap body, the outlet configured to allow air entering the lint trap body to exit towards the building exhaust stack through a duct, wherein the lint trap body is a sealed member preventing the exhaust from exiting the lint trap body to living space.

2. The lint trap of claim 1, further comprising a backflow preventer disposed in the duct connecting the lint trap to building exhaust stack.

3. The lint trap of claim 1, further comprising an in-duct exhaust fan disposed in the duct connecting the lint trap to the building exhaust stack.

4. The lint trap of claim 3, wherein the duct is connected to an existing exhaust fan which works synergistically with the in-duct exhaust fan and an on-roof exhaust fan to affect efficient evacuation of relatively lint free dryer exhaust air.

5. The lint trap of claim 4, wherein the in-duct exhaust fan as well as the existing exhaust fan are interlocked with the dryer to allow simultaneous start and stop.

6. The lint trap of claim 1, wherein the water in the lint trap body is designed to trap any lint carryover from the dryer allowing relatively lint free air to exhaust through the duct into the building exhaust stack.

7. The lint trap of claim 1, wherein the inlet and outlet are sealed to the lint trap body and the duct is sealed to the building exhaust stack to allow the exhaust from the dryer to be discharged to outside atmosphere, preventing release of saturated hot air into a living space and thereby preventing creation of conditions that promote deadly molds.

8. The lint trap of claim 1, wherein the lint trap and at least a portion of the duct are housed in a closet with the dryer which allows a laundry station to fit into an apartment/condominium décor without undue clutter.

9. A dryer exhaust system consisting essentially of:

a lint trap having a lint trap body operable to contain a pool of water therein;

an inlet to the lint trap body, the inlet configured to connect to an exhaust of a dryer, the inlet directing the exhaust from the dryer toward the pool of water;

an outlet from the lint trap body, the outlet allowing air entering the lint trap body to exit towards a building exhaust stack through a duct, wherein the lint trap body is a sealed member preventing the exhaust from exiting the lint trap body to living space.

10. The dryer exhaust system of claim 9, further including a backflow preventer disposed in the duct connecting the lint trap to building exhaust stack.

11. The dryer exhaust system of claim 9, further including an in-duct exhaust fan disposed in the duct connecting the lint trap to the building exhaust stack.

12. The dryer exhaust system of claim 11, wherein the duct is connected to an existing exhaust fan which works synergistically with the in-duct exhaust fan and an on-roof exhaust fan to affect efficient evacuation of relatively lint free dryer exhaust air.

13. The dryer exhaust system of claim 12, wherein the in-duct exhaust fan as well as the existing exhaust fan are interlocked with the dryer to allow simultaneous start and stop.

14. The dryer exhaust system of claim 9, wherein the water in the lint trap body is designed to trap any lint carryover from the dryer allowing relatively lint free air to exhaust through the duct into the building exhaust stack.

15. The dryer exhaust system of claim 9, wherein the inlet and outlet are sealed to the lint trap body and the duct is sealed to the building exhaust stack to allow the exhaust from the dryer to be discharged to outside atmosphere, preventing release of saturated hot air into a living space and thereby preventing creation of conditions that promote deadly molds.

16. The dryer exhaust system of claim 9, wherein the lint trap and at least a portion of the duct are housed in a closet with the dryer which allows a laundry station to fit into an apartment/condominium décor without undue clutter.

* * * * *